US005348300A

United States Patent [19]

Jennings

[11] Patent Number: 5,348,300

[45] Date of Patent: Sep. 20, 1994

[54] COSMIC COMMUNICATION CUBES

[76] Inventor: Melvin R. Jennings, P.O. Box 11291, Jackson, Miss. 39213

[21] Appl. No.: 94,212

[22] Filed: Jul. 21, 1993

Related U.S. Application Data

[63] Continuation-in-part of Ser. No. 970,184, Nov. 2, 1992, abandoned.

[51] Int. Cl.[5] ..... A63F 9/04

[52] U.S. Cl. ..... 273/146; 446/14

[58] Field of Search ..... 273/146; 446/14

[56] References Cited

U.S. PATENT DOCUMENTS

| | | | |
|---|---|---|---|
| D. 142,576 | 1/1945 | Morris | 273/146 |
| 3,400,932 | 6/1965 | Conrad | 273/146 |
| 3,495,832 | 2/1970 | Thomassen-Behle | 273/146 |
| 3,799,554 | 3/1974 | Simons | 273/146 |
| 4,164,351 | 8/1979 | Baker | 273/146 |
| 5,018,738 | 5/1991 | Padi | 273/146 |
| 5,223,958 | 6/1993 | Berry | 273/146 |

FOREIGN PATENT DOCUMENTS

| | | | |
|---|---|---|---|
| 3425102 | 1/1986 | Fed. Rep. of Germany | 273/146 |

*Primary Examiner*—Benjamin H. Layno

*Attorney, Agent, or Firm*—Ostrolenk, Faber, Gerb & Soffen

[57] ABSTRACT

A set of dice, each die being a transparent, six-sided cube. A number of extrusions or marking indicia are located on each of the outer surfaces of the dice and are numbered, lettered or otherwise designated. The interior of each die is hollow, with small impressions on the inner surfaces located directly opposite the extrusions. A ball is disposed inside each die and is free to move around the hollow interior. The interior impressions are sized so that the ball will settle in one of the impressions when the die comes to rest after being thrown. Each of the impressions lies directly beneath a an extrusion or marking indicia on the upwardly facing outer surface of the die, which is read to determine the outcome of the toss. Thus, each toss of the dice will generate different numbers for use in games of chance such as lotteries and the like.

12 Claims, 3 Drawing Sheets

COSMIC COMMUNICATION CUBES

This is a continuation-in-part of application Ser. No. 07/970,184, filed Nov. 2, 1992, now abandoned.

BACKGROUND OF THE INVENTION

1. Field of the Invention

The present invention relates to dice for generating random numbers and, more particularly, to hollow, transparent dice containing an internal ball which randomly determines the selected number upon a roll of the dice.

2. Description of the Related Art

A conventional set of dice consists of a pair of small cubes marked on each face with from one to six spots. Dice are used in various games of chance. Dice typically are shaken and/or thrown and allowed to come to rest at random on a flat surface. The result of the toss is presented on the upward-facing surfaces of the dice.

Variations on conventional dice concepts have been created and patented. Specifically, dice having a hollow interior containing a spherical metal ball are shown in U.S. Pat. No. 142,576 to Morris; U.S. Pat. No. 3,400,932 to Conrad; U.S. Pat. No. 5,018,738 to Padi; and German Patent Application No. 3425102 to Hopp. Generally, the interior metal spheres of these previously patented devices orient a conventional die by providing a low center of gravity. The interior balls in the dice of these prior art patents do not determine the number selected by the dice when they are rolled. Moreover, prior art dice are limited in the numbers which may be selected.

Thus, there is a need for dice which can randomly generate high numbers and complex combinations such as those which might be encountered in a multi-number lottery game system.

SUMMARY OF THE INVENTION

The present invention comprises a set of dice, each die being a transparent, six-sided cube. A number of extrusions or indicia are located on each of the outer surfaces of the dice and are numbered, lettered or otherwise designated. The interior of each die is hollow, with small impressions on the inner surfaces located directly opposite the extrusions. A ball is disposed inside each die and is free to move around the hollow interior.

The interior impressions are sized so that the ball will settle in one of the impressions when the die comes to rest after being thrown. Each of the impressions lies directly beneath an extrusion or marking indicia on the upwardly facing outer surface of the die, which is read to determine the outcome of the toss. Thus, each toss of the dice will generate different numbers for use in games of chance such as lotteries and the like.

Optionally, the dice may be constructed of a thermoplastic material capable of changing color or hue based on the heat generated by the hands of the user, or by friction, thereby adding to the complexity of the information generated by each roll of the dice.

In addition, each die within the set may be tinted a different color or different groupings of colors may be utilized, in order to impart significance to each particular die or groupings of dice.

Other features and advantages of the present invention will become apparent from the following description of the invention which refers to the accompanying drawings.

DETAILED DESCRIPTION OF THE PREFERRED EMBODIMENT

Figure 1:
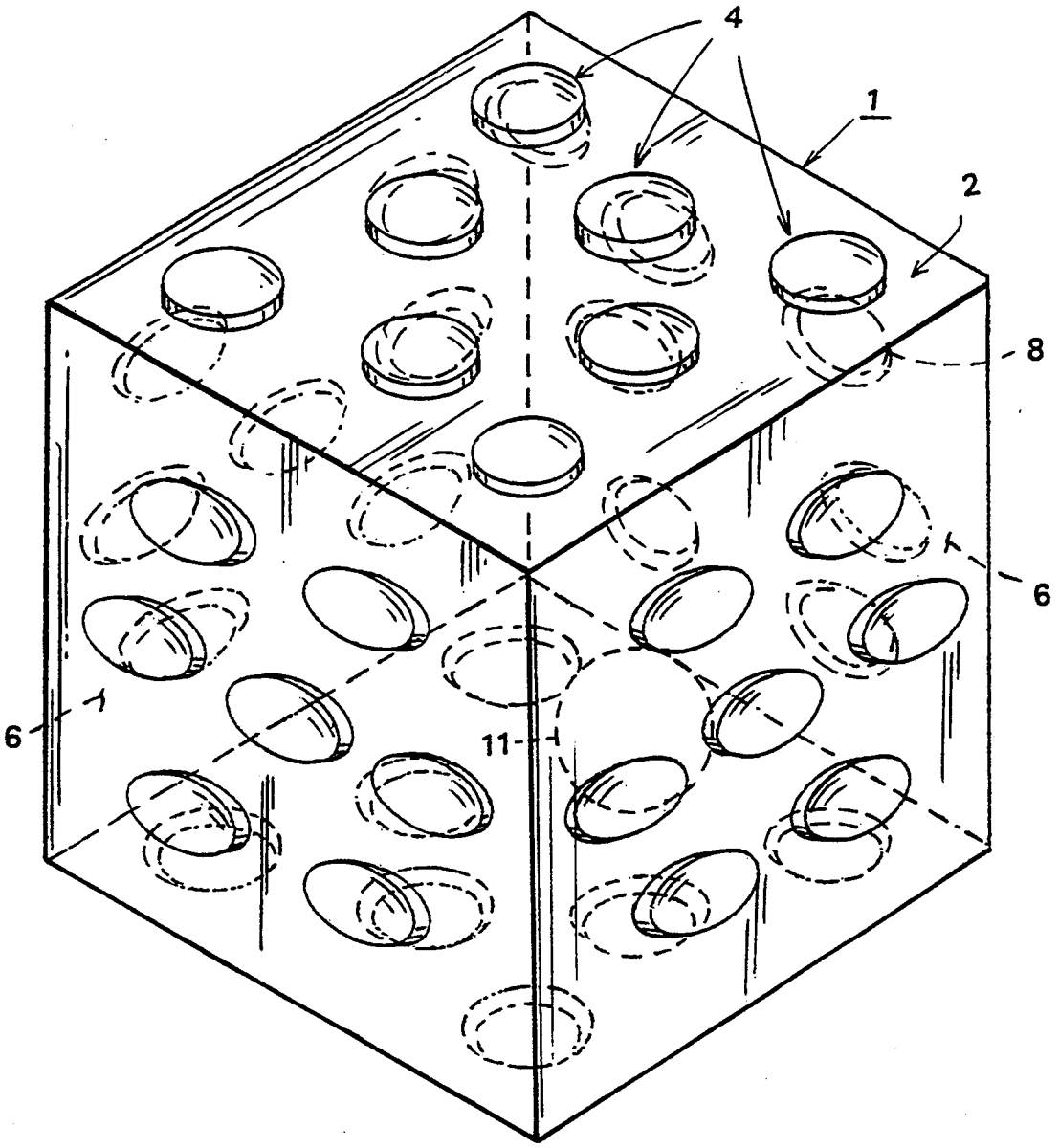
FIG. 1 is an isometric view of the die of the present invention, illustrating the indicating extrusions and the internal, outcome selecting sphere.

Referring first to FIG. 1, the die of the present invention is indicated generally by reference numeral 1. Die 1 has six outer surfaces 2, each with a plurality of extrusions 4. The extrusions 4 may be designated with numbers or letters. Die 1 has a hollow, cube-shaped interior defined by the six inner surfaces 6, each of which has a plurality of impressions or dimples 8 located directly opposite a corresponding extrusion 4 on the outer surfaces.

A spherical ball 11 is disposed in the interior of die 1, and is free to move within the space defined by interior surfaces 6.

The body of the die is preferably formed of a clear plastic material. Optionally, the clear plastic may be tinted to provide various color combinations. Alternatively, the plastic may be formed of a material which changes color based on temperature, such as when the die is heated by the hands of the user or by friction generated upon mechanical agitation.

The extrusions 4 and impressions 8 are preferably molded into the die as part of the manufacturing process. Alternatively, the extrusions 4 may be separate pieces detachable from the surface of the cube, thus allowing the die to be customized for use in various games or applications.

Spherical ball 11 is composed of any suitable material including plastic, metal, wood, rubber, etc. The ball 11 is of a weight and size sufficient to allow the ball to come to rest unambiguously within one of the dimples, and, in the preferred embodiment, is of equal weight as the shell of die 1.

In operation, die 1 is ordinarily used as one of a set of dice to be shaken in the hand of a user, within a cup, or agitated by other commonly known mechanical means. After sufficient manipulation, the dice are released and allowed to come to rest on a preferably flat surface. Once at rest, the internal spherical ball 11 will come to rest within one of the upwardly facing dimples 8 on the bottom surface. The outcome selected by the dice is determined by reading the value of the extrusion directly above the location where ball 11 comes to rest.

Figure 2:
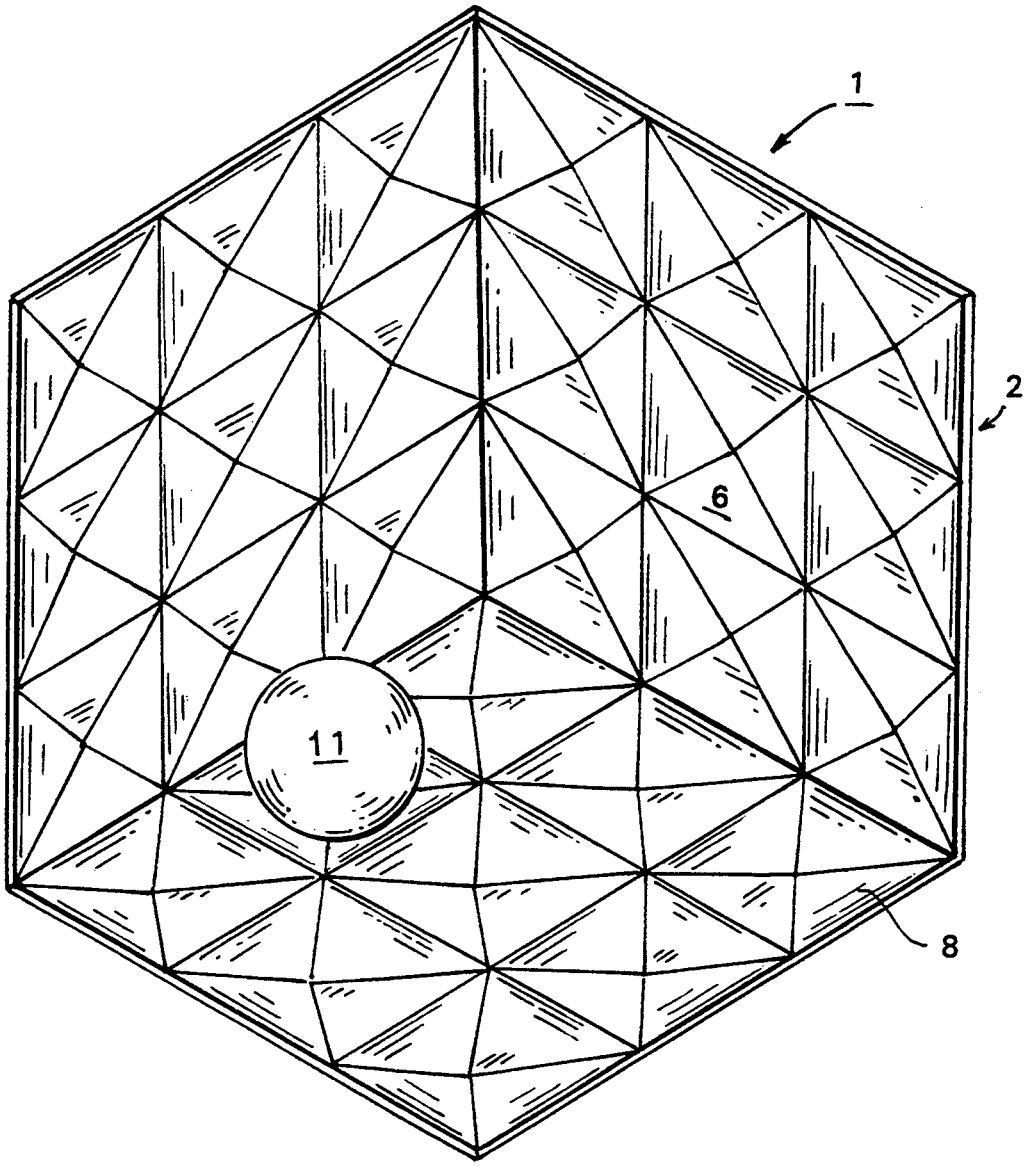
FIG. 2 is a cut-away view showing the interior of the die of the present invention, illustrating an alternative method of providing resting positions for the outcome selecting sphere.

FIG. 2, in which corresponding reference numerals represent corresponding elements to FIG. 1, illustrates a cut-away view of the interior of a die cube showing an alterative method of providing unique resting positions for the outcome selecting sphere. Other possible configurations include raised ridges dividing the areas. Preferably, the areas in which the sphere will come to rest are of equal size to provide equal opportunity for selection of each number position.

Figure 3:
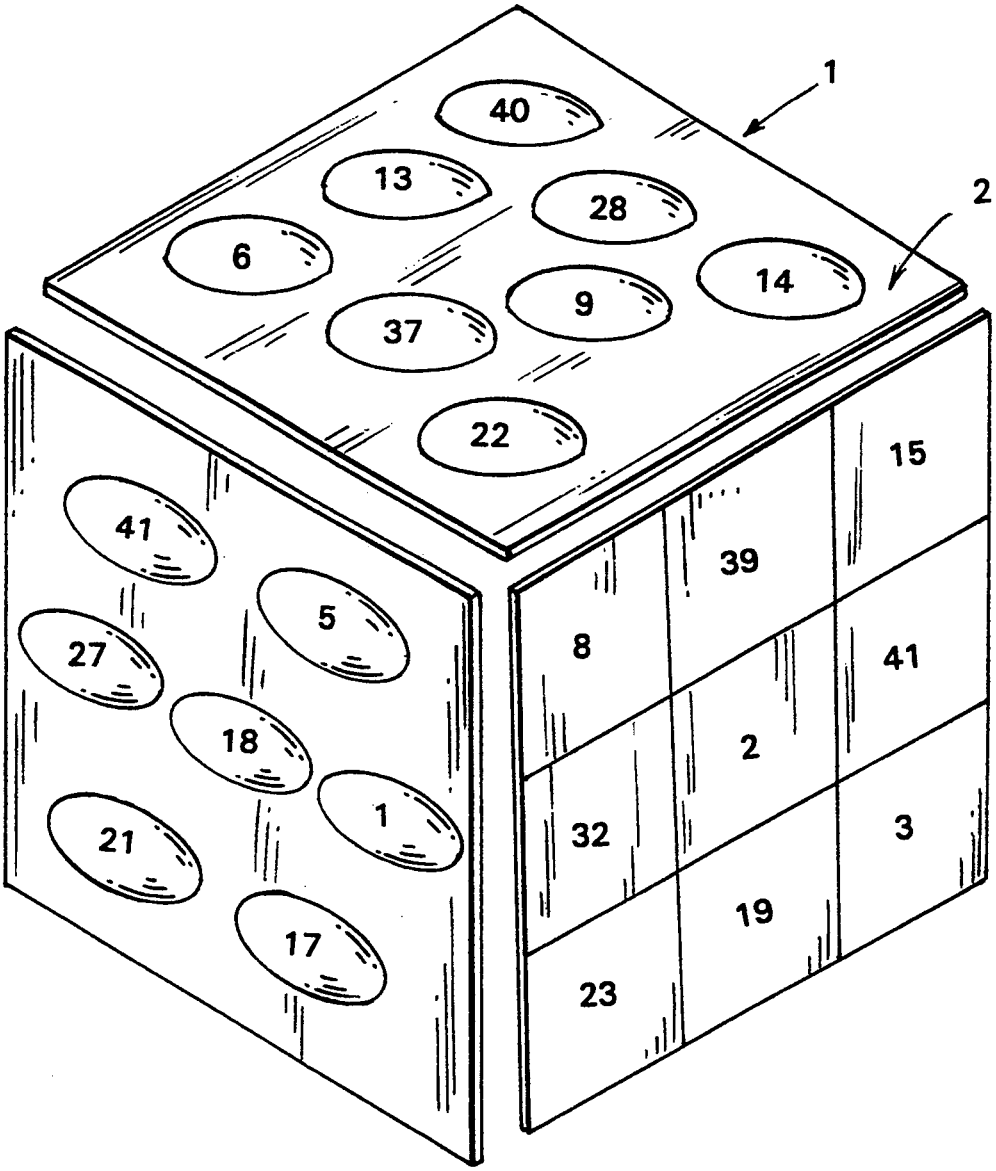
FIG. 3 illustrates three possible alternative layouts for the outer surfaces of the dice.

FIG. 3 illustrates three numbering arrangements among those which may be utilized in carrying out the present invention. Thus, for example, each side of the cube may contain seven, eight or nine different numbers; additionally, as shown in FIG. 3, the sides of the cube may have different numbering arrangements—for example, four sides of the cube may contain seven numbers and the other two sides of the cube may contain eight numbers. Numbering may be sequential (e.g. 1 to 48 for a cube having seven number per side; or 1 to 54 for a cube having eight numbers per side) or random. Numbers may also be placed on the inside of the cube on or around the dimples to specify the outcome. Multiple numbers can also be placed on or around each indicating position to make the cube more easily readable.

Further significance may be imparted to the values generated by each of the dice by providing various colors for each die. Of course, any number of extrusions or indicia may be provided on the surfaces of the dice, limited only by the physical size of the dice and reasonable, unambiguous readability of the outcome generated by each toss of the dice.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A die having a hollow interior, comprising:

a transparent body having a plurality of outer surfaces, a plurality of inner surfaces, and a space within said inner surfaces defining said hollow interior;

a plurality of marking indicia disposed on each of said outer surfaces;

a plurality of impressions in each of said inner surfaces located at positions directly opposite to said marking indicia on said outer surfaces; and a spherical member freely movable in the hollow interior, said spherical member having a weight equal to the weight of said hollow die without said spherical member;

whereby, upon being rolled, said die will come to rest on an outer surface, and said spherical member will come to rest in one of the impressions.

2. A die as recited in claim 1, wherein said marking indicia comprise extrusions.

3. A die as recited in claim 2, comprising six inner and outer surfaces.

4. A die as recited in claim 3, wherein each of said six outer surfaces of said die has eight extrusions.

5. A die as recited in claim 4, wherein said extrusions are numbered sequentially from 1 to 48.

6. A die as recited in claim 3, wherein four of said six outer surfaces of each die have seven extrusions and two of said six outer surfaces of said die have eight extrusions.

7. A die as recited in claim 6, wherein said extrusions are numbered sequentially from 1 to 44.

8. A die as recited in claim 3, wherein each of said six outer surfaces contains nine extrusions.

9. A die as recited in claim 8, wherein said extrusions are numbered sequentially from 1 to 54.

10. A die as recited in claim 1, wherein said spherical member is a metal ball.

11. A die as recited in claim 1, wherein said transparent body is constructed of a transparent thermoplastic material, the color of which changes based upon the temperature of the material.

12. A die as recited in claim 1, wherein said transparent body of a die is tinted in color.

* * * * *